United States Patent [19]

Mori et. al

[11] Patent Number: 4,986,895

[45] Date of Patent: Jan. 22, 1991

[54] PROCESS FOR TREATING COAL TAR OR COAL TAR PITCH

[75] Inventors: Makihiko Mori, Kitakatsuragi; Katsumi Fujita, Osaka; Yoshiteru Nakagawa, Yamatokoriyama; Yasunori Goda, Takarazuka; Toyohiro Maeda, Tenri, all of Japan

[73] Assignee: Osaka Gas Company Limited, Osaka, Japan

[21] Appl. No.: 403,908

[22] Filed: Sep. 5, 1989

Related U.S. Application Data

[63] Continuation of Ser. No. 216,364, Jul. 7, 1988, abandoned, which is a continuation-in-part of Ser. No. 719,101, Apr. 9, 1985, abandoned.

[30] Foreign Application Priority Data

Aug. 29, 1983 [JP] Japan ..... 58-158658

[51] Int. Cl.[5] ..... C10C 1/20; C10C 3/02

[52] U.S. Cl. ..... 208/39; 208/22; 208/44; 208/42

[58] Field of Search ..... 208/22, 39, 41, 44

[56] References Cited

U.S. PATENT DOCUMENTS

| | | | |
|---|---|---|---|
| 2,774,716 | 12/1956 | Kulik | 208/39 |
| 4,036,603 | 7/1977 | Bernet et al. | 208/39 |
| 4,267,061 | 5/1981 | Simo et al. | 208/39 |
| 4,277,325 | 7/1981 | Greenwood | 208/22 |
| 4,283,269 | 8/1981 | Greenwood | 208/22 |
| 4,436,615 | 3/1984 | Boodman et al. | 208/39 |
| 4,482,452 | 11/1984 | Shigeta et al. | 208/39 |
| 4,533,461 | 8/1985 | Izumi et al. | 208/44 |
| 4,589,974 | 5/1986 | Izami | 208/22 |

FOREIGN PATENT DOCUMENTS

| | | | |
|---|---|---|---|
| 180585 | 10/1983 | Japan | 208/39 |
| 1007386 | 1/1986 | Japan | 208/39 |

*Primary Examiner*—Helane E. Myers

*Attorney, Agent, or Firm*—Larson & Taylor

[57] ABSTRACT

Pitch substantially free from primary and secondary QI components and solids comprising secondary QI components are prepared by centrifuging coal tar or coal tar pitch at a high temperature, heat-treating the separated supernatant liquid and centrifuging again the liquid at a high temperature.

8 Claims, No Drawings

PROCESS FOR TREATING COAL TAR OR COAL TAR PITCH

CROSS REFERENCE TO RELATED APPLICATION

This application is a continuation of application Ser. No. 216,364 filed July 7, 1988, now abandoned, which was a continuation-in-part of application Ser. No. 719,101 filed Apr. 9, 1985, now abandoned.

TECHNICAL FIELD

This invention relates to novel processes for treating coal tar and coal tar pitch (hereinafter the both are represented by coal tar).

BACKGROUND ART

In producing high-quality carbon materials such as needle coke, carbon fiber or the like from coal tar, quinoline insoluble components (hereinafter referred to as "QI components") contained as impurities in the coal tar must be removed to the utmost extent. The QI components in coal tar are carbonaceous materials in the form of fine particles 0.3 μm or less in particle size (such QI components are generally called "primary QI components"). When coal tar contains a large amount of primary QI components, the primary QI components tend to adhere to the surface of mesophase bodies (spherulites) generally called "secondary QI components" during the heat treatment of the coal tar. The adhesion of primary QI components is presumed to inhibit the coalescence of the spherulites and to hinder their normal growth.

For this reason, the removal of primary QI components from coal tar has been recognized as important. For example, a method has been practiced in which oil of such property that the oil and coal tar are hardly miscible in each other, e.g. petroleum-type light oil, is added to coal tar to aggregate the primary QI components of the coal tar into particles of increased particle size and the mixture is left to stand to separate the enlarged primary QI components by sedimentation (Japanese Unexamined Patent Publication No.28501/1977). This method requires the distillation of the supernatant liquid after removing the primary QI components in order to get tar and/or pitch as a useful component and recovery the oil initially added by distillation. The distillation of the liquid requires a great amount of thermal energy and also results in low yields of the useful component. Further, the oil recovered by the distillation is a mixture of the petroleum-type oil added and coal-type oil derived from coal tar and thus has a limited value unless further treated. Since the precipitate phase separated by standing contains a large amount of petroleum-type oil, the oil as added would be recovered at a low ratio if the precipitate is not subjected to a treatment for the recovery of oil. The recovery treatment requires equipments such as a distillation column, tanks, etc. Moreover, this method involves the use of a large-size tank for storing petroleum-type light or middle oil to be used and related installations, consequently demanding a wide space for arrangement of the equipment.

DISCLOSURE OF INVENTION

We have conducted extensive research to solve or moderate the aforementioned problems encountered in carrying out the conventional methods and found the following.

(i) When coal tar is centrifuged at high temperatures, the primary QI components are efficiently separated with ease.

(ii) When the supernatant liquid separated by the centrifugation at high temperatures as described in (i) above is heat-treated, the secondary QI components can be easily formed without interference from the primary QI components. As a result, a high-quality pitch which substantially contains only pure secondary QI components is obtained. The resulting pitch is useful as materials for needle coke and carbon fiber.

(iii) When the high-quality pitch prepared by the same procedure as described in (ii) is centrifuged again at high temperatures, a high-quality pitch substantially free from the primary and secondary QI components is prepared. The pitch thus obtained is extremely useful as materials for needle coke and carbon fiber, and pitch for impregnation.

(iv) The mixture obtained by admixing solids which comprise the primary QI components as separated above in (i) with coal tar or pitch is useful as materials for producing high-quality binder pitches.

(v) Meso-carbon microbeads comprising the secondary QI components obtained by washing the solids separated by the secondary centrifugation as described above in (iii) are extremely useful as starting materials for high-quality carbon materials.

The present invention has been accomplished based on these novel findings and provides:

A process for treating coal tar or coal tar pitch containing primary QI components 0.3 μm or less in particle size comprising the steps of subjecting a material consisting essentially of coal tar or coal tar pitch to a primary centrifugation at a temperature of 200 to 400° C. to form primary QI component solids and a primary supernatant coal tar or coal tar pitch liquid substantially free of primary QI components, separating the supernatant from the solids, heat-treating the separated supernatant at a temperature of 300 to 500° C. and a pressure ranging from ambient pressure to 20 kg/cm$^2$ G for 0.5 to 50 hours to form a coal tar product or coal tar pitch product containing secondary QI components, subjecting the heat-treated supernatant to a secondary centrifugation at a temperature of 150 to 450° C. to form solids comprising secondary QI components and a secondary supernatant coal tar or coal tar pitch substantially free of primary and secondary QI components, and separating the secondary supernatant from the solids to recover the secondary QI components as a useful material.

In the present invention, it is preferable to remove the components boiling at less than the centrifugation temperature by distilling the starting coal tar before centrifugation.

Coal tar is centrifuged in the first step at 200 to 400° C. The centrifugation at less than 200° C. entails difficulty in removing a sufficient amount of primary QI components and centrifugation at temperatures over 400° C. involves an increased tendency to generate gas due to the thermal decomposition of tar or to change in the properties of tar. More preferably, the centrifugal temperature is from 200 to 350° C. Various types of centrifuges can be used which are operable at the temperatures in the above range. The centrifugal force to be applied is usually about 500 to about 4000 G, preferably about 2000 to about 3500 G. The percent removal of QI components is suitably determined according to the properties of starting coal tar, kind of the end product, the desired properties of end product, etc. When the solids separated by centrifugation are added to coal tar which is not subjected to centrifugation and are mixed therewith, the properties of coal tar are improved and the mixture can be effectively used as starting materials for various types of binder pitches.

The supernatant liquid separated by the centrifugation is heat-treated at the second step in a temperature of 300 to 500° C. and a pressure in the range of around ambient pressure to 20 kg/cm$^2$·G for about 0.5 to about 50 hours. Preferably, heat treatment is carried out at a temperature of about 350 to about 450° C. under the same pressure and time conditions as above. The heat treatment at less than 300° C. entails difficulty in the progress of polycondensation not only of pitch contained in starting coal tar but of heavy components contained in tar oil or condensed ring compounds having relatively low boiling point, high reactivity and instability, so that high-quality pitch cannot be obtained. The heat treatment at temperatures over 500° C. entails difficulty in operating apparatus for heat treatment and preparing high-quality pitch because of coking trouble therein. When the heat treatment is carried out at pressures over 20 kg/cm$^2$·G, improvements of the effects cannot be attained, whereas the treatment at pressures lower than ambient pressure results in low yield of pitch by the loss of low boiling components. In general, the higher the reaction temperature is, the shorter the time required for the completion of reaction will be. The secondary QI components are formed in the reaction product during the heat treatment.

In the present invention, the reaction product resulting from the foregoing heat treatment is further treated by secondary centrifugation at high temperatures to obtain high-quality pitch substantially free from the primary and secondary QI components. Prior to the secondary centrifugation, components boiling at lower than the centrifugal temperature can be removed by distillation, when required. The secondary centrifugation is conducted at a temperature of 150 to 450° C. The centrifugation at lower than 150° C. entails difficulty in removing a sufficient amount of secondary QI components and centrifugation at temperatures over 450° C. involves a tendency to impair the properties of resulting tar. A more preferable secondary centrifugal temperature is from 200 to 400° C. The centrifugal force to be applied is usually about 500 to about 5000 G, preferably about 2000 to about 4000 G.

The reaction product with the secondary QI components removed to a desired extent is distilled in a conventional manner to adjust its softening point according to use. The pitch finally obtained can be substantially free from the primary and secondary QI components and is extremely useful as starting materials for high-quality needle coke and carbon fiber, pitch for impregnation, etc. Specially, when used as the material for needle coke, the pitch does not develop abnormal expansion (puffing) during graphitization. Therefore, there is no need of using $Fe_2O_3$, and thus the pitch is extremely useful.

The secondary QI components (meso-carbon microbeads) obtained by washing solids separated by the secondary centrifugation with oil such as benzene, toluene, xylene, creosote oil, etc. can be effectively used as starting materials for high-density isotropic carbon articles such as devices for producing semiconductors, electrodes for electrical discharge machining, etc.

EXAMPLE 1

Dehydrated coal tar (containing 2.0% by weight of primary QI components) was centrifuged at a high temperature to give supernatant liquid (containing trace amounts of primary QI components). The centrifuge used was of the transverse- and continuous-type having a holding volume of 40 l and was operated at a revolution rate of 3000 rpm, a centrifugal force of 2280 G, a temperature of 200° C. and a treating amount of 1 ton per hour.

The supernatant liquid was heat-treated at a temperature of 380° C. and a pressure of 3 kg/cm$^2$·G for 14 hours to give a reaction product (containing 2.5% by weight of secondary QI components) in a yield of 75% by weight (based on dehydrated coal tar). The properties of the product thus obtained are shown in Table 1 below.

TABLE 1

| Softening point (R & B method) | BI (wt. %) | QI (wt. %) | β-resin (wt. %) |
|---|---|---|---|
| 40.2° C. | 26.2 | 2.5 | 23.7 |

The reaction product was then subjected to a secondary centrifugation at a revolution rate of 3000 rpm, a centrifugal force of 2280 G, a temperature of 270° C. and a treating amount of 1 ton/hour, using the same centrifuge as employed above.

The product thus separated as a supernatant liquid was distilled to give a pitch having the properties as listed in Table 2 below, in a yield of 55% (based on dehydrated tar).

TABLE 2

| Softening point (R & B method) | QI (wt. %) | TI (wt. %) |
|---|---|---|
| 87.5° C. | 0 | 31.5 |

A 80 part-by-weight portion of the above pitch was mixed with 20 part-by-weight of hydrogenated heavy anthracene oil which was obtained by hyhdrogenation of heavy anthracene oil (5% distillation temperature of 300° C., 50% distillation temperature of 360° C., aromaticity =0.97) at a hydrogen pressure of 100 kg/cm$^2$ and a temperature of 380° C. for 3 hours in the presence of 7% by weight of $Ni/Mo/Al_2O_3$ catalyst based on the heavy anthracene oil. The mixture was heat-treated at a temperature of 420° C. for 2.5 hours while blowing $N_2$ gas into the mixture at a rate of 5 l/min per 1 kg of the mixture. The mixture was left to stand to separate heat-treated pitch.

The heat-treated pitch was spun at a temperature of 330° C. and the filaments obtained were subjected to infusion treatment at a temperature of 250° C. for 3 hours in an atmosphere of oxygen. The filaments were heated at a temperature of 1200° C. for 3 hours in an atmosphere of nitrogen to give carbon fibers of 7 μm in diameter and having a tensile strength of 243 kg/mm$^2$ (average value of 15 samples).

EXAMPLE 2

Dehydrated coal tar (containing 2.0% by weight of primary QI components) was centrifuged primarily in the same manner as Example 1 to give supernatant liquid. The supernatant liquid was heat-treated at a temperature of 395° C. and a pressure of 3 kg/cm$^2$·G for 16 hours to obtain a reaction product. The reacted tar thus heat-treated (containing 3.4% by weight of secondary QI components) was centrifuged at a revolution rate of 3000 rpm, a centrifugal force of 2280 G, a temperature of 270° C. and a treating amount of 1 ton/hr.

The properties of soft pitch thus obtained is listed in Table 3 below. The yield of soft pitch was 73% based on the dehydrated tar.

TABLE 3

| Softening point (R & B method) | BI (wt. %) | QI (wt. %) | β-resin (wt. %) |
|---|---|---|---|
| 39.1° C. | 24.2 | trace | 24.2 |

The soft pitch obtained as above and containing only pure secondary QI components was carbonized at a temperature of 470° C. and a pressure of 6.3 kg/cm$^2$·G to produce raw coke. Subsequently, the raw coke was calcined at a temperature of 1400° C. to form needle coke (bulk density of 2.16 g/cc). The needle coke was molded with a binder pitch into a shaped body of 16 mm in diameter and 130 mm in length and was graphitized at 2700° C. The properties of the electrode piece as produced above is shown in Table 4 below.

TABLE 4

| | Thermal Expansion Coefficient ($\times 10^{-7}$/° C.) | Abnormal Expansion (Puffing) |
|---|---|---|
| Example 2 | 2.9 | not observed |

EXAMPLE 3

The general procedure of Example 2 was followed by subjecting dehydrated coal to a primary centrifugation, heat-treating the supernatant liquid thus obtained, and subjecting the resulting reaction product to a secondary centrifugation, separating soft pitch from the solids containing secondary QI components.

Five parts by weight of toluene was added to 1 part by weight of the solids obtained. The solids were fully washed with the toluene at ambient temperature to produce meso-carbon microbeads. The properties of the microbeads thus prepared are shown in Table 5 below.

TABLE 5

| | |
|---|---|
| Toluene insoluble | 95 wt. % |
| Quinoline insoluble | 87 wt. % |
| Volatile matter | 10 wt. % |
| Diameter | 2 to 15 μm |

The meso-carbon microbeads obtained above were molded into a body having a diameter of 40 mm and a height of 10 mm under a pressure of 1.5 ton/cm$^2$ and graphitized at 2800° C. The properties of the test piece thus produced were determined with the result indicated in Table 6 below.

TABLE 6

| | |
|---|---|
| Density | 1.92 g/cm$^2$ |
| Bending strength | 900 kg/cm$^2$ |
| Electric specific resistance | 1500 μΩ · cm |

The meso-carbon microbeads prepared according to the present invention are spherular so that clearly the carbon material obtained is isotropic and high in density and strength.

EXAMPLES 4 to 6

Dehydrated coal tar containing 2.0% by weight of primary QI components was centrifuged primarily in the same manner as Example 1 to give a supernatant liquid substantially free of primary QI components.

Each of the samples of supernatant thus obtained was heat-treated at a temperature of 385° C. (Examples 4 and 6) or at 395° C. (Example 5) and at a pressure of 3 kg/cm$^2$·G for 16 hours to obtain a reaction product substantially free of primary and secondary QI components.

The reaction product containing 3.4% by weight of secondary QI components was centrifuged under the same conditions as those in the secondary centrifugation in Example 2 to separate solids comprising secondary QI components from supernatant.

The properties of the supernatant from the secondary centrifugation (soft pitch) are given in Table 7.

TABLE 7

| | Softening point (R & B method) | BI (wt. %) | QI (wt. %) | β-resin (wt. %) |
|---|---|---|---|---|
| Ex. 4 | 38.0° C. | 22.0 | 0 | 22.0 |
| Ex. 5 | 39.1° C. | 24.2 | trace | 24.2 |
| Ex. 6 | 38.0° C. | 22.0 | 0 | 22.0 |

Toluene was added to the solids to wash the solids in the similar manner as in Example 3.

The properties of the meso-carbon microbeads thus obtained are shown in Table 8 below with the amount of toluene in parts by weight per 1 part by weight of microbeads used in the washing step.

TABLE 8

| | Amount of toluene | TI (wt. %) | QI (wt. %) | VM (wt. %) | Diameter (μm) |
|---|---|---|---|---|---|
| Ex. 4 | 4 | 94 | 87 | 11 | 1–12 |
| Ex. 5 | 8 | 98 | 88 | 8 | 2–15 |
| Ex. 6 | 8 | 98 | 87 | 8 | 1–12 |

The meso-carbon microbeads obtained as above were molded in the same manner as in Example 3 and properties of the molded test pieces were determined. The results are shown in Table 9.

TABLE 9

| | Density (g/cm$^2$) | Bending strength (kg/cm$^2$) | Electric specific resistance (μΩ · cm) |
|---|---|---|---|
| Ex. 4 | 1.94 | 1000 | 1450 |
| Ex. 5 | 1.94 | 1030 | 1500 |
| Ex. 6 | 1.95 | 1100 | 1400 |

What is claimed is:

1. A process for treating a material consisting essentially of coal tar or coal tar pitch containing primary QI component solids 0.3 μm or less in particle size comprising the steps of:

(a) subjecting said material to a primary centrifugation at a temperature of from 200 to 400° C. to separate said primary QI component solids and to form a primary supernatant coal tar or coal tar pitch liquid substantially free of said primary QI component solids;

(b) separating said primary supernatant from said primary QI component solids;

(c) heat-treating said primary supernatant at a temperature at a temperature and pressure and for a time sufficient to form in said primary supernatant secondary QI component solids in the form of meso-carbon microbeads, said temperature being within the range of 300 to 500° C., said pressure being in the range of ambient to 20 kg/cm$^2$ G, and said time being from ½ to 50 hours;

(d) subjecting said primary supernatant from step (c) to a secondary centrifugation at a temperature of from 150 to 450° C. to separate said secondary QI component solids and to form a secondary supernatant coal tar or coal tar pitch substantially free of said primary and secondary QI component solids;

(e) separating said secondary supernatant from said secondary QI component solids; and (f) recovering said secondary QI component solids as a product useful for making high density isotropic carbon articles.

2. A process as defined in claim 2 in which the primary centrifugation is carried out at a temperature of 200 to 350° C.

3. A process as defined in claim 1 in which the primary centrifugation is performed at a centrifugal force of 500 to 4000 G.

4. A process as defined in claim 1 in which the primary centrifugation is effected at a centrifugal force of 2000 to 35000 G.

5. A process as defined in claim 1 in which the heat treatment is conducted at a temperature of 350 to 450° C.

6. A process as defined in claim 1 in which the secondary centrifugation is carried out at a temperature of 200 to 400° C.

7. A process as defined in claim 1 in which the secondary centrifugation is performed at a centrifugal force of 500 to 5000 G.

8. A process as defined in claim 1 in which the secondary centrifugation is effected at a centrifugal force of 2000 to 4000 G.

* * * * *